US005797526A

United States Patent [19]

Wells

[11] Patent Number: 5,797,526

[45] Date of Patent: Aug. 25, 1998

[54] METHOD FOR CREATING A DECORATIVE BOW

[75] Inventor: Jeannette M. Wells, Coral Springs, Fla.

[73] Assignee: Wenzer Group, Inc., Coral Springs, Fla.

[21] Appl. No.: 689,413

[22] Filed: Aug. 9, 1996

[51] Int. Cl.[6] ..... A41M 43/00

[52] U.S. Cl. ..... 223/46; 223/44; 223/1

[58] Field of Search ..... 223/46, 44, 1; 28/149, 151, 142, 143, 147

[56] References Cited

U.S. PATENT DOCUMENTS

| | | | |
|---|---|---|---|
| 254,288 | 2/1882 | Dimmick | 28/149 |
| 1,010,155 | 11/1911 | Lange | 223/46 |
| 1,446,316 | 2/1923 | Niemiec et al. | 28/149 |
| 1,537,790 | 5/1925 | Alpe | 28/149 |
| 1,865,785 | 7/1932 | Parker | 28/147 |
| 3,501,070 | 3/1970 | Shattuck | 223/46 |
| 3,591,904 | 7/1971 | Rosene | 28/147 |
| 5,411,188 | 5/1995 | Teuten | 223/46 |
| 5,435,048 | 7/1995 | Walker | 28/149 |

*Primary Examiner*—Bibhu Mohanty
*Attorney, Agent, or Firm*—Lackenbach Siegel Marzullo Aronson & Greenspan, PC

[57] ABSTRACT

In a preferred embodiment, an apparatus for creating a decorative bow, including: a frame member having a central opening; and at least two hook members disposed on the frame member around the opening, the at least two hook members being constructed so that a continuous elastic band can be stretched between a selected pair of the at least two hook members across the central opening, such that loops of fabric may be formed between sides of the continuous elastic band, between the elastic band and another elastic band, and/or between the elastic band and the frame member, two or more of the loops of fabric forming the decorative bow.

6 Claims, 18 Drawing Sheets

METHOD FOR CREATING A DECORATIVE BOW

BACKGROUND OF THE INVENTION

1. Field of the Invention

The present invention relates to decorative bows generally and, more particularly, but not by way of limitation, to novel apparatus and method for creating decorative bows.

2. Background Art

Decorative bows are used in a wide variety of applications, such as for hair ornaments, tying scarfs, and decorating packages, to name only a few. In most cases, some means of attaching the ends of the bows together must be provided in order to keep the bows from unraveling or the loops of the bows must be attached together by some means. Many times, this is simply accomplished by tying the ends of the bows together in a knot or the bow itself may be in the form of a knot. Sometimes, as is often the case for decorative bows to be used for packages, the bows are held together by stapling them to an adhesive-backed substrate. Other times, pins or other types of fasteners are employed. Anytime a fastener is used which requires penetrating the fabric of the bow, the fabric is damaged and it may not be possible to reuse the fabric.

A problem in making relatively complicated decorative bows is that it is difficult to form the bow without some means to hold the various folds of the bow in place before it is finished.

Accordingly, it is a principal object of the present invention to provide apparatus and method for creating decorative bows which eliminate the need for tying knots or using fasteners through the fabric of the bows.

It is a further object of the invention to provide such apparatus and method that can be used to create a variety of different decorative bows for a variety of uses.

It is another object of the invention to provide such apparatus and method that are easily used.

It is an additional object of the invention to provide such apparatus from which the bow fabric can be used without damage to the fabric.

A further object of the invention is to provide such apparatus that is economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an apparatus for creating a decorative bow, comprising: a frame member having a central opening; and at least two hook members disposed on said frame member around said opening, said at least two hook members being constructed so that a continuous elastic band can be stretched between a selected pair of said at least two hook members across said central opening, such that loops of fabric may be formed between sides of said continuous elastic band, between said elastic band and another elastic band, and/or between said elastic band and said frame member, two or more of said loops of fabric forming said decorative bow.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1A:
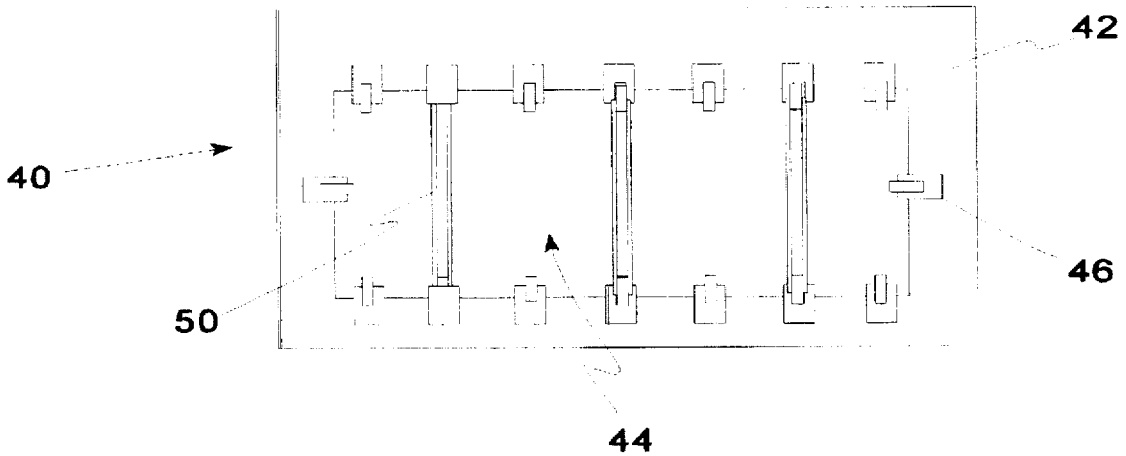
FIG. 1(A) is a top plan view of a basic embodiment of an apparatus according to the present invention.
Figure 1B:
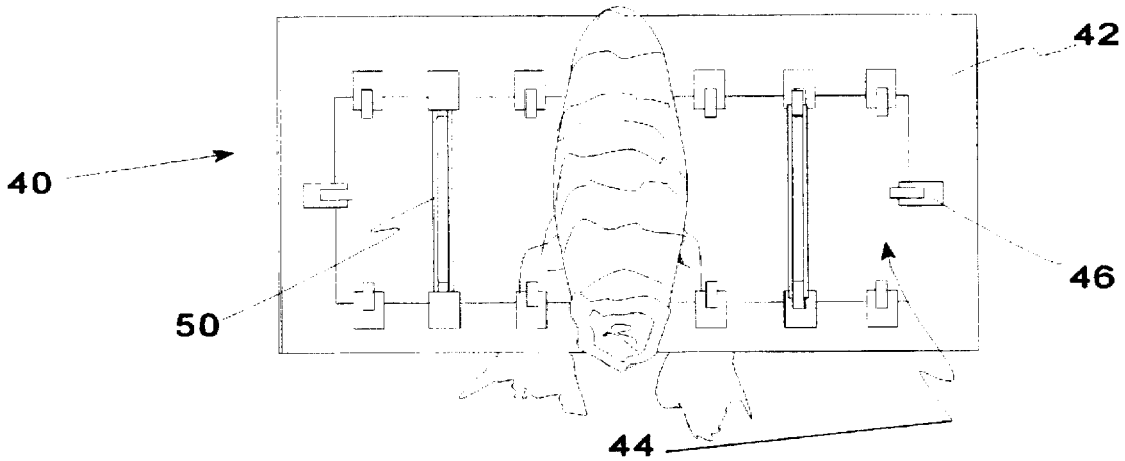
FIGS. 1(B)–(E) are top plan views of the embodiment of FIG. 1(A) showing how the apparatus of FIG. 1(A) is used to form a decorative bow.
Figure 1C:
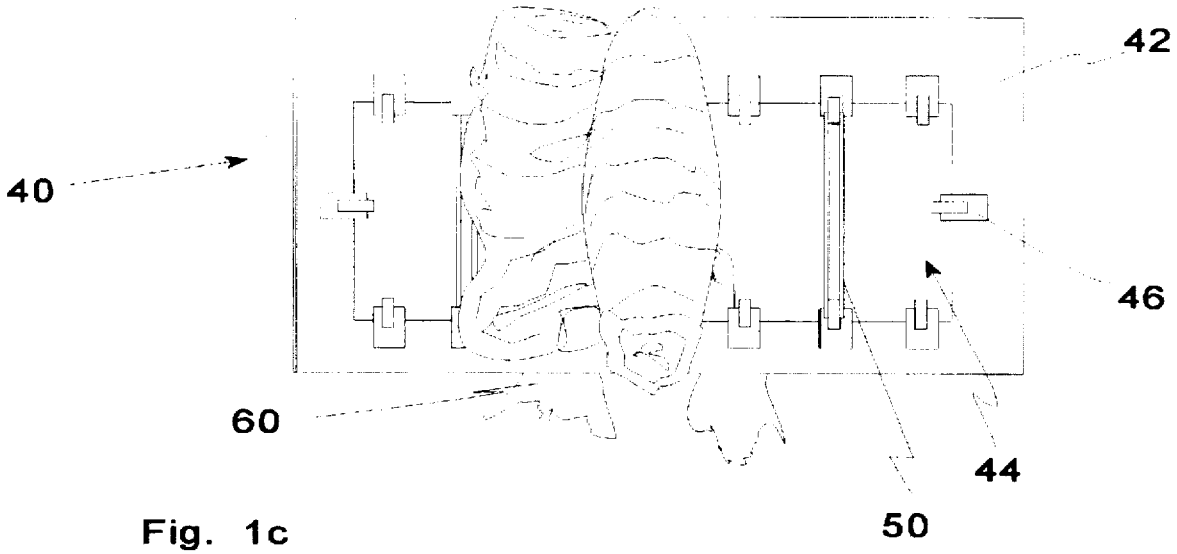
Figure 1D:
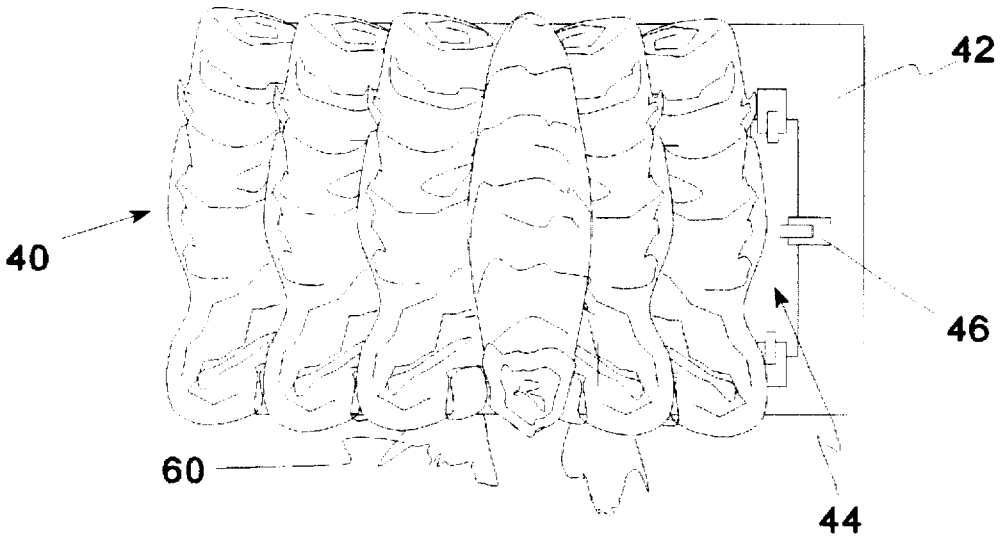

Reference should now be made to the drawing figures, on which similar or identical elements are given consistent identifying numerals throughout the various figures, and on which parenthetical references to figure numbers direct the reader to the view(s) on which the element(s) being described is (are) best seen, although the element(s) may be seen also on other views.

FIG. 1(A) illustrates one embodiment of an apparatus according to the present invention, generally indicated by the reference numeral 40. Apparatus 40 includes a rectilinear frame member 42 having a central opening 44, with hook members, as at 46, disposed around the central opening. As shown on FIG. 1(A), three, evenly spaced apart, vertical, elastic bands 50 have been stretched between vertically aligned pairs of hook members 46.

FIGS. 1(B)–(E) illustrate apparatus 40 (FIG. 1(A)) being used to form a decorative bow with a fabric 60, the fabric in this case being an oblong scarf 60. Scarf 60 is folded in half and the resulting fold inserted upwardly through the middle of center elastic band 50 and the loop so created is puffed up, as shown on FIG. 1(B). Similarly, the left portion of scarf 60 is used to create a loop between center and left elastic bands 50, as shown on FIG. 1(C). Then, the right portion of scarf 60 is used to create a loop between center and right elastic bands 50 and the remaining left portion of the scarf is used to create a loop between left elastic band 50 and the left side of frame member 42, as shown on FIG. 1(D). Finally, as shown on FIG. 1(E), the remaining right portion of scarf 60 is used to create a loop between right elastic band 50 and the right side of frame member 42, thus creating a five-loop, decorative bow that may be worn in the hair by suitable attachment thereto or used for one of a number of other purposes.

Figure 1E:
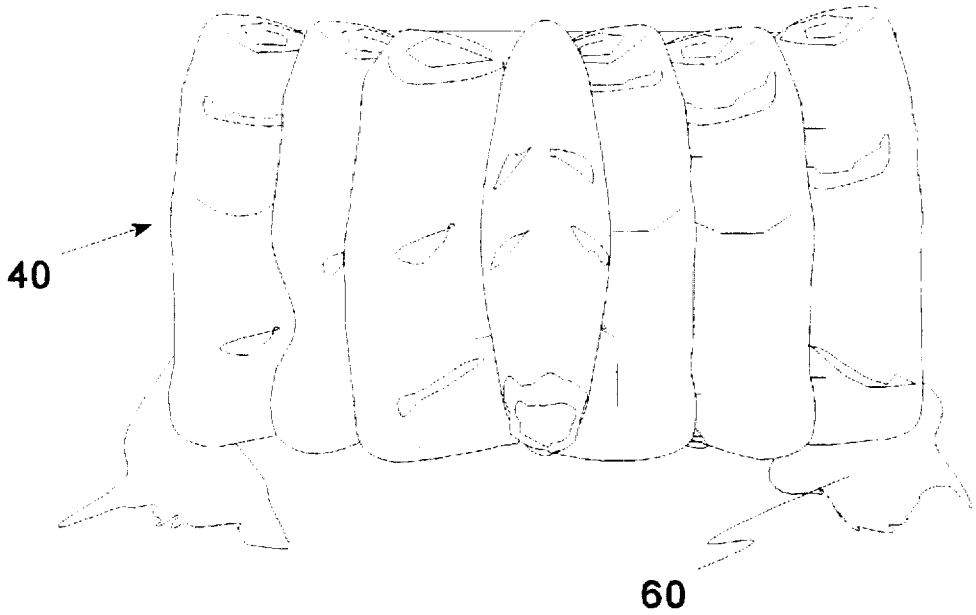
Figure 2A:
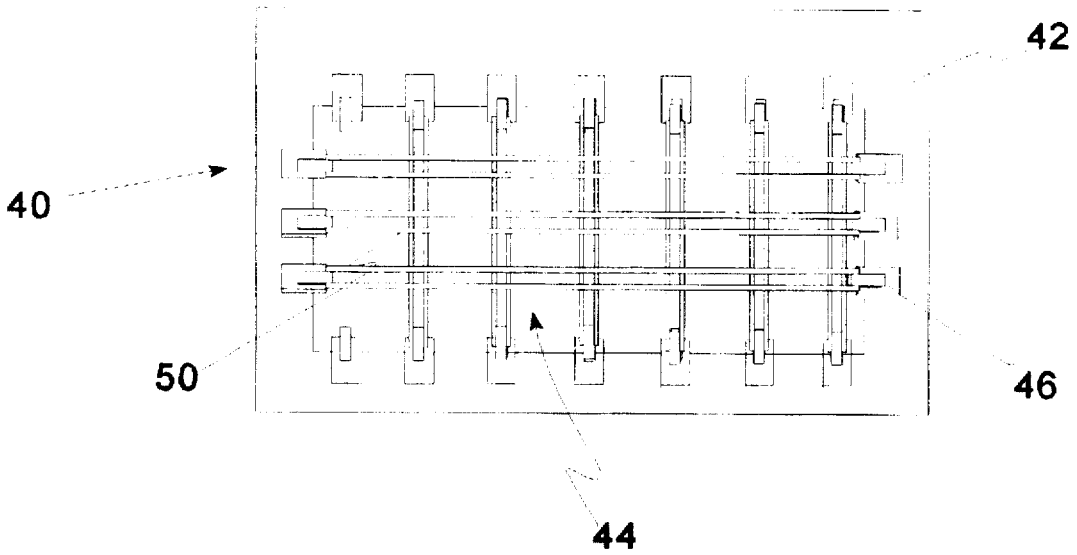
FIG. 2(A) is a top plan view of another embodiment of an apparatus according to the present invention.
Figure 2B:
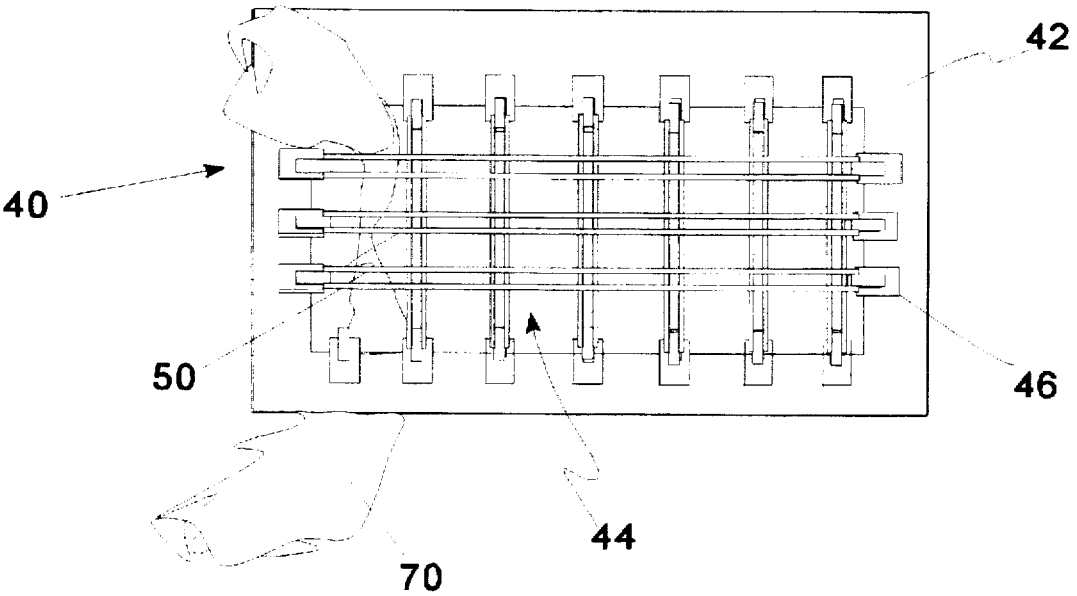
FIGS. 2(B)–(E) are top plan views of the embodiment of FIG. 2(A) showing how the apparatus of FIG. 2(A) is used to form a decorative bow.
Figure 2C:
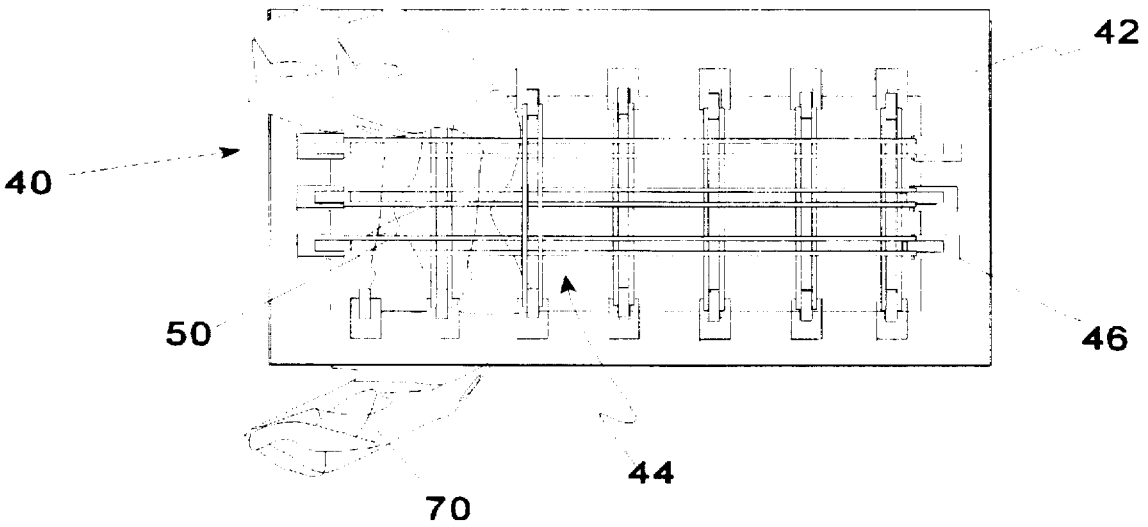
Figure 2D:
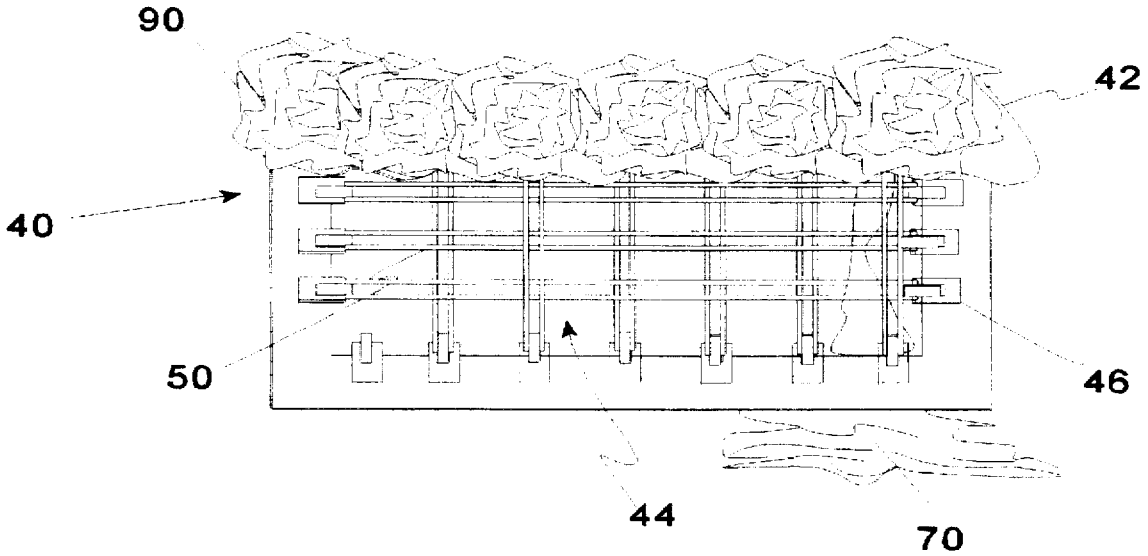
Figure 2E:
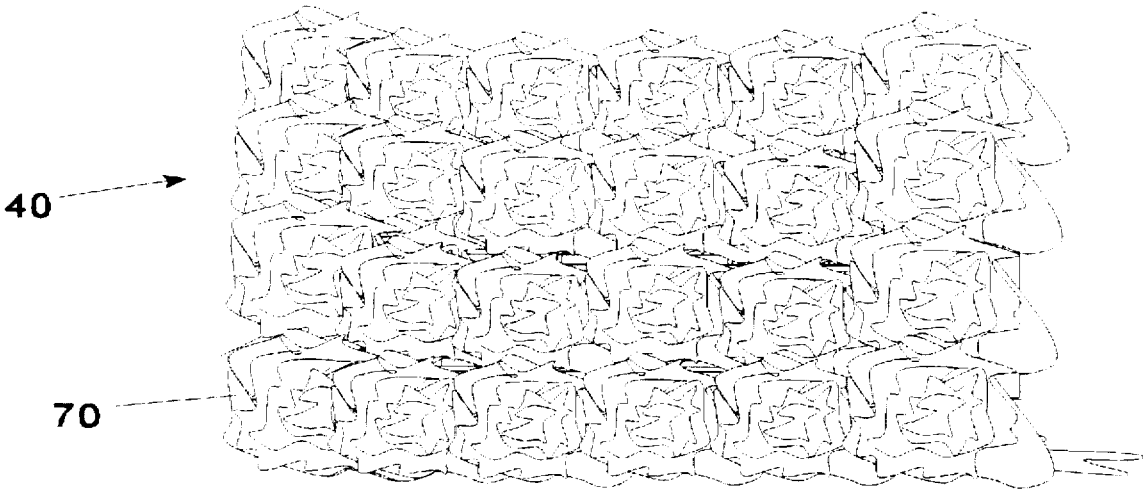

FIG. 2(A) illustrates apparatus 40 having both vertical and horizontal elastic bands, as at 50, stretched between vertically and horizontally aligned hook members, as at 46. FIGS. 2(B)–(E) illustrate apparatus 40 as shown on FIG. 2(A) being used to create a multi-loop, decorative bow (FIG. 2(E)) using a length of ribbon 70, in the same manner as described with reference to FIGS. 1(B)–(E). The loops of ribbon 70 may be formed between only the spaces between elastic bands 50 and the spaces between the elastic bands and the edges of frame member 42 or, for a fuller bow, loops can additionally be created between sides of each elastic band. Short pieces of matching ribbon (not shown) can be pushed through around the edges of frame member 42 to have several ends showing. Another variation is to use two or more contrasting ribbons or to use ribbons with flat and shiny surfaces. Other decorative variations are contemplated by the present invention as well.

Figure 3:
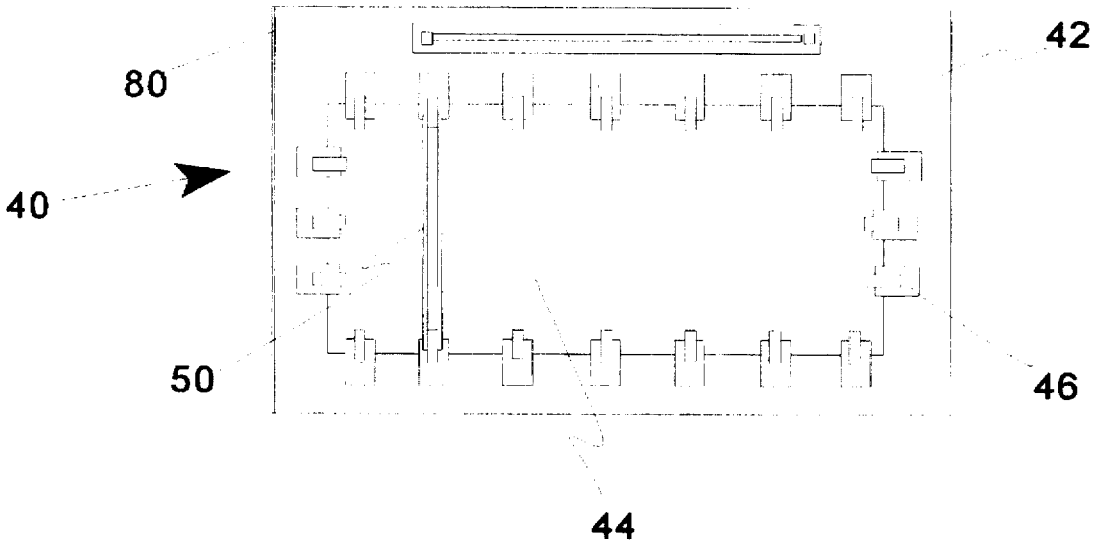
FIGS. 3 and 4 are top plan views of additional embodiments of apparatuses according to the present invention.

FIG. 3 illustrates apparatus 40 with the addition of a pin 80 attached to frame member 42 which pin can be used, for example, to fasten a completed bow (not shown) to a blouse at the neckline or to use the bow as a brooch.

Figure 4:
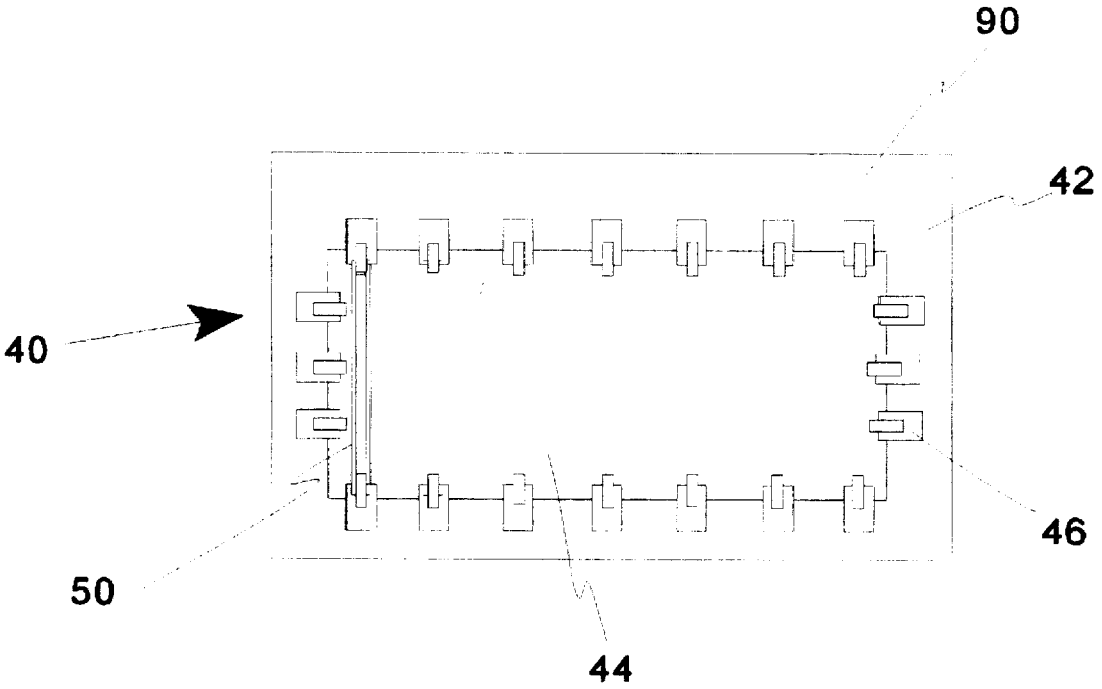

FIG. 4 illustrates apparatus 40 with the addition of a barrette 90 attached to frame member 42 which barrette can be used to fasten a completed bow (not shown) to a person's hair.

Figure 5A:
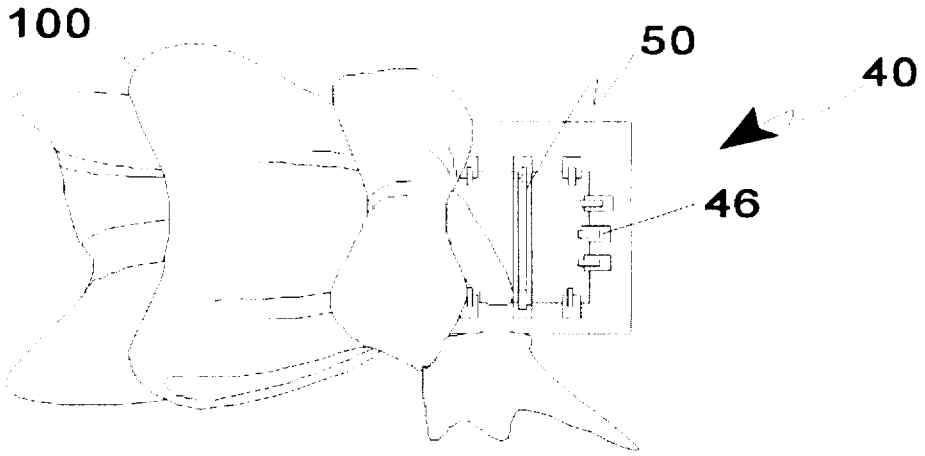
FIGS. 5(A)–(B) are top plan views of the apparatus of either FIG. 3 and 4 being used to form a decorative bow
Figure 5B:
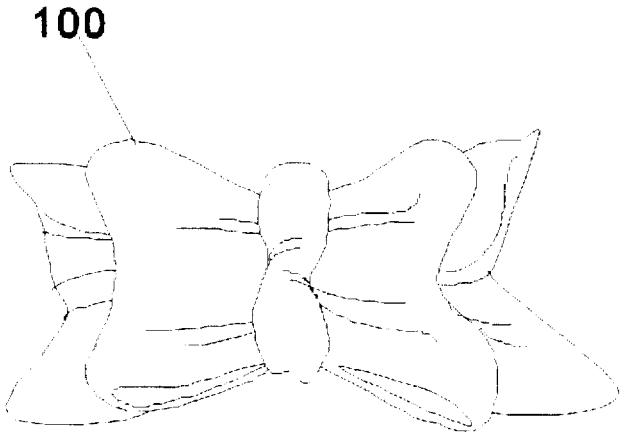

FIGS. 5(A)–(B) illustrate how apparatus 40 can be used with a length of ribbon 100 to create a five-loop bow having an appearance different from that of the bow shown on FIG. 1(E) by varying the lengths of the loops created with the ribbon.

Figure 6A:
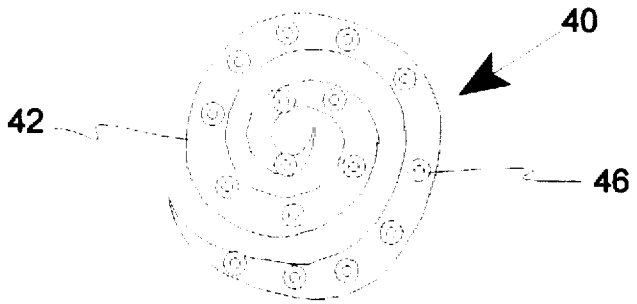
FIG. 6(A) is a top plan view of another embodiment of an apparatus according to the present invention.
Figure 6B:
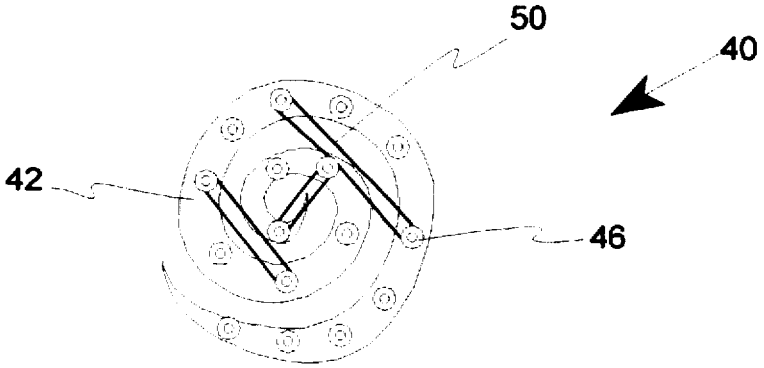
FIGS. 6(B)–(C) are top plan views of the embodiment of FIG. 6(A) showing how the apparatus of FIG. 6(A) is used to form a decorative bow.
Figure 6C:
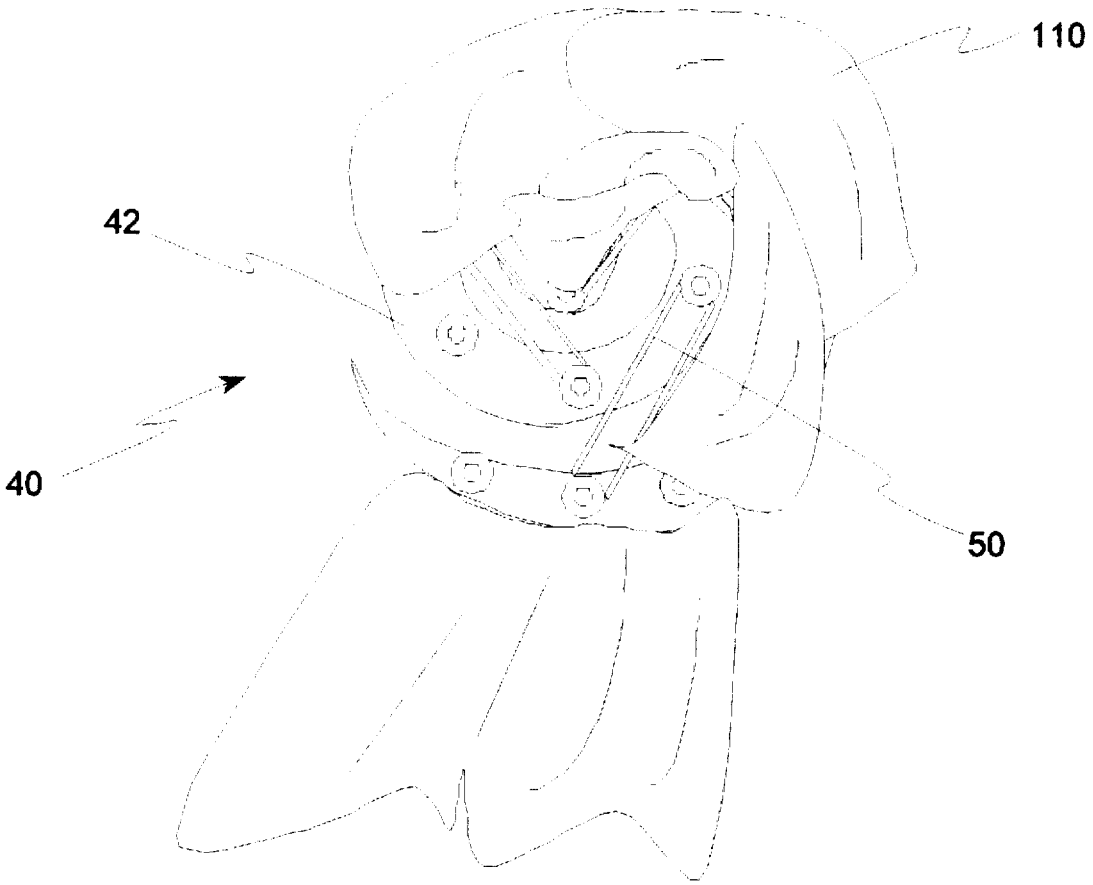

FIG. 6(A) illustrates apparatus 40 in the form of a spiral. Elastic bands, as at 50 (FIG. 6(B)) are stretched between selected pairs of hook members, as at 46, and then loops of fabric 110 are created through and between the elastic bands and/or between the elastic bands and frame member 42 in petal-like fashion. Frame member 42 may be planar or it may have a three-dimensional shape approximating that of a conch shell.

Figure 7A:
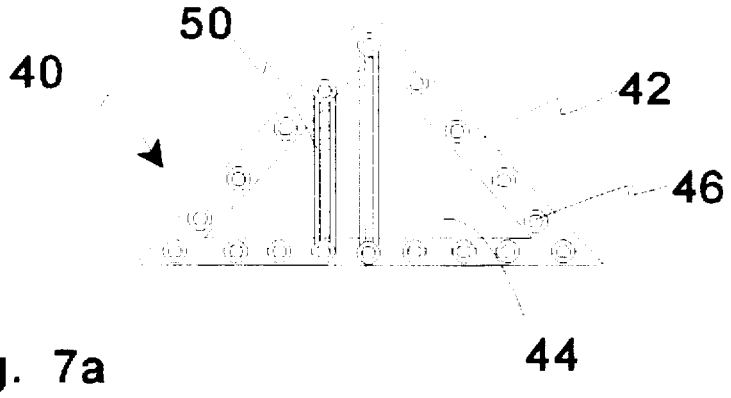
FIGS. 7(A)–(B) are top plan views of another embodiment of an apparatus according to the present invention.
Figure 7B:
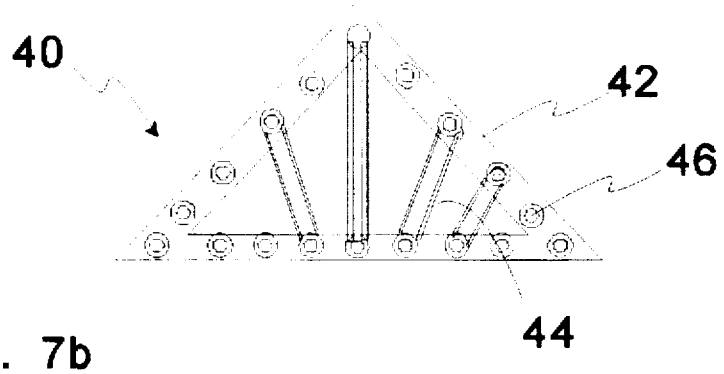
Figure 7C:
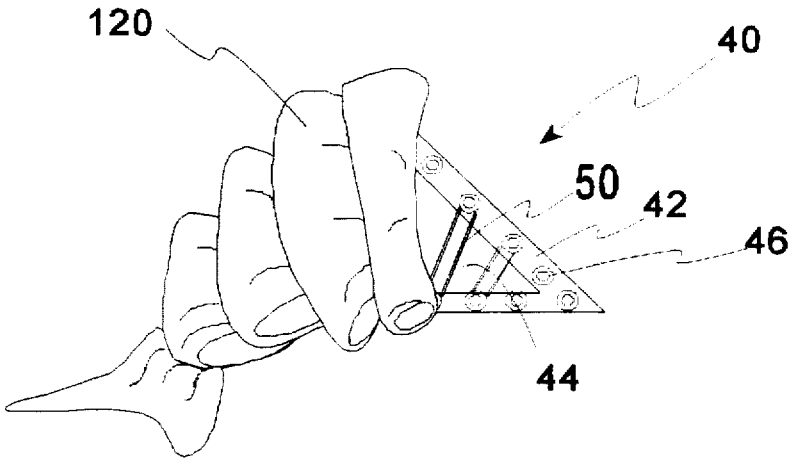
FIG. 7(C) is a top plan view of the embodiment of FIG. 7(A) showing how the apparatus of FIG. 7(A) is used to form a decorative bow.

FIGS. 7(A)–(B) illustrate apparatus 40 with frame member 42 in the shape of a triangle to create triangular bows and show alternative arrangements of elastic bands, as at 50. FIG. 7(C) illustrates the creating of a triangular, decorative bow from fabric 120.

Figure 8A:
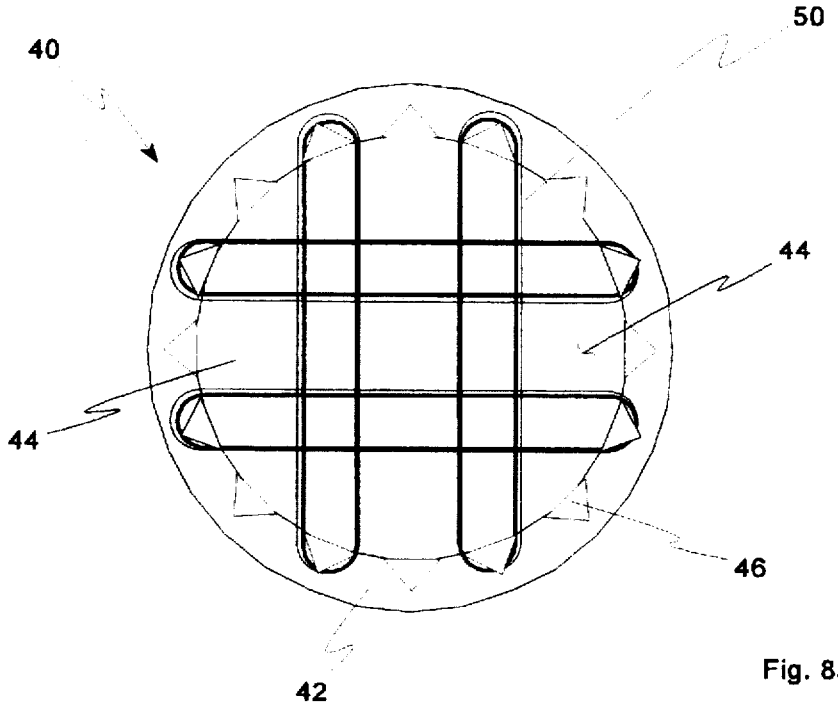
FIGS. 8(A) and 8(B) are top plan views of other embodiments of apparati according to the present invention.
Figure 8B:
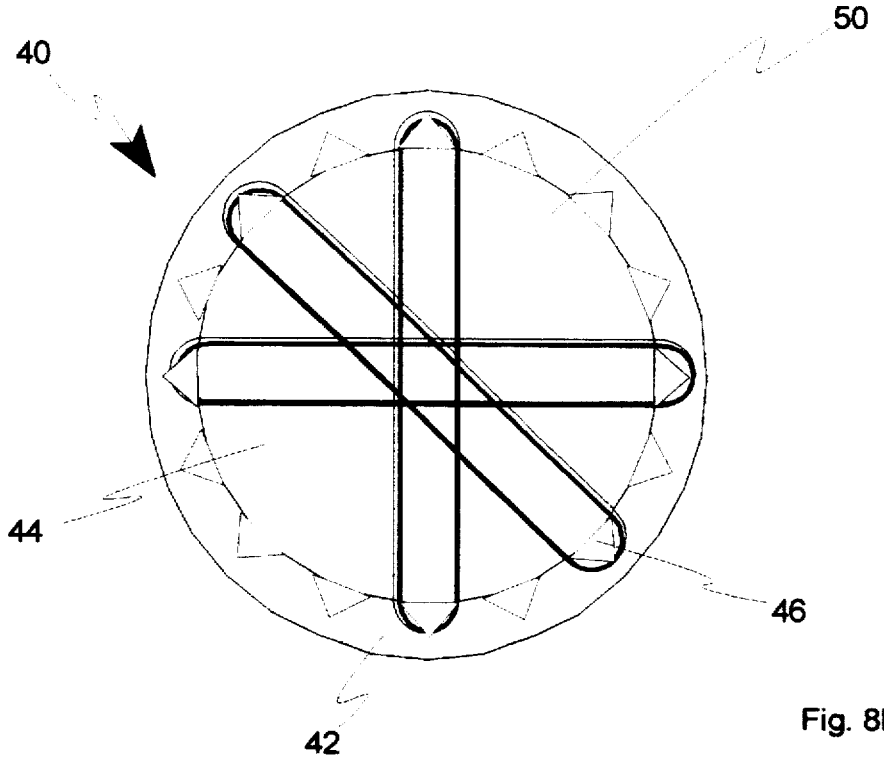

FIGS. 8(A)–(B) illustrate apparatus 40 with frame member 42 in the form of an annulus and showing alternative arrangements for stretching elastic bands, as at 50, between pairs of hook members, as at 46. As will be understood from FIGS. 8(A)–8(B), as well as the previous figures, there is great flexibility in selecting the numbers and arrangement of elastic bands 50 to produce a great variety of different decorative bows, even with only one frame member 42.

Figure 9:
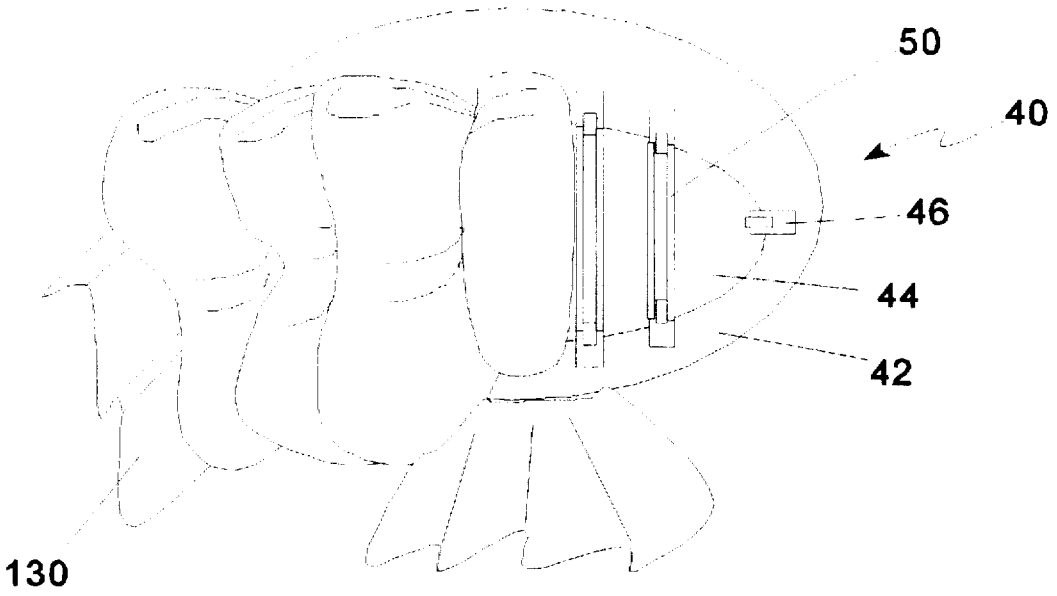
FIGS. 9 and 10 are top plan views of other embodiments of apparati according to the present invention being used to form decorative bows.

FIG. 9 illustrates apparatus 40 having frame member 42 in a somewhat oval shape, with a decorative bow being created with fabric 130, and with the frame having a widened portion 132 at the top thereof which widened portion is visible after the creation of the decorative bow.

Figure 10:
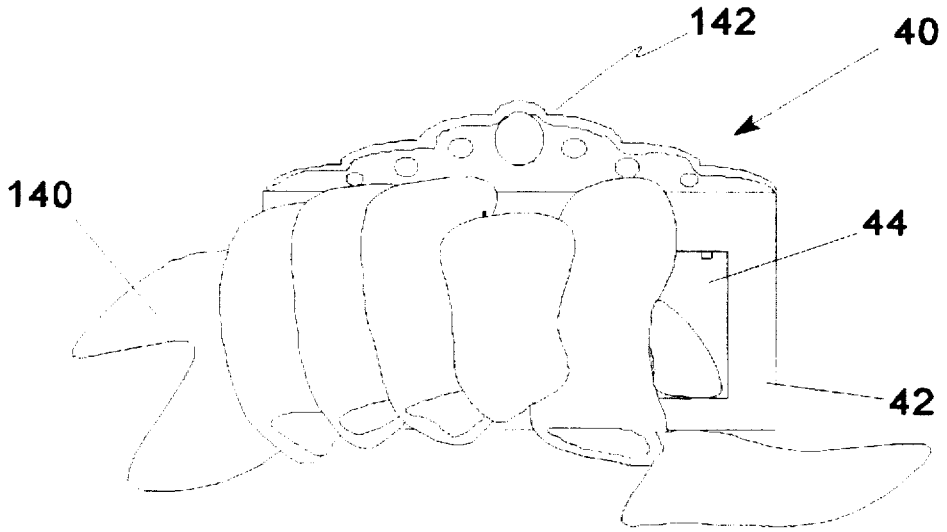

FIG. 10 illustrates apparatus 40 having frame member 42 in a rectangular shape, with a decorative bow being created with fabric 140, and with the frame having a decorative member 142 at the top thereof visible after the creation of the decorative bow.

It will be understood from FIGS. 9 and 10 that many such variations are possible and within the contemplation of the present invention.

Figure 11:
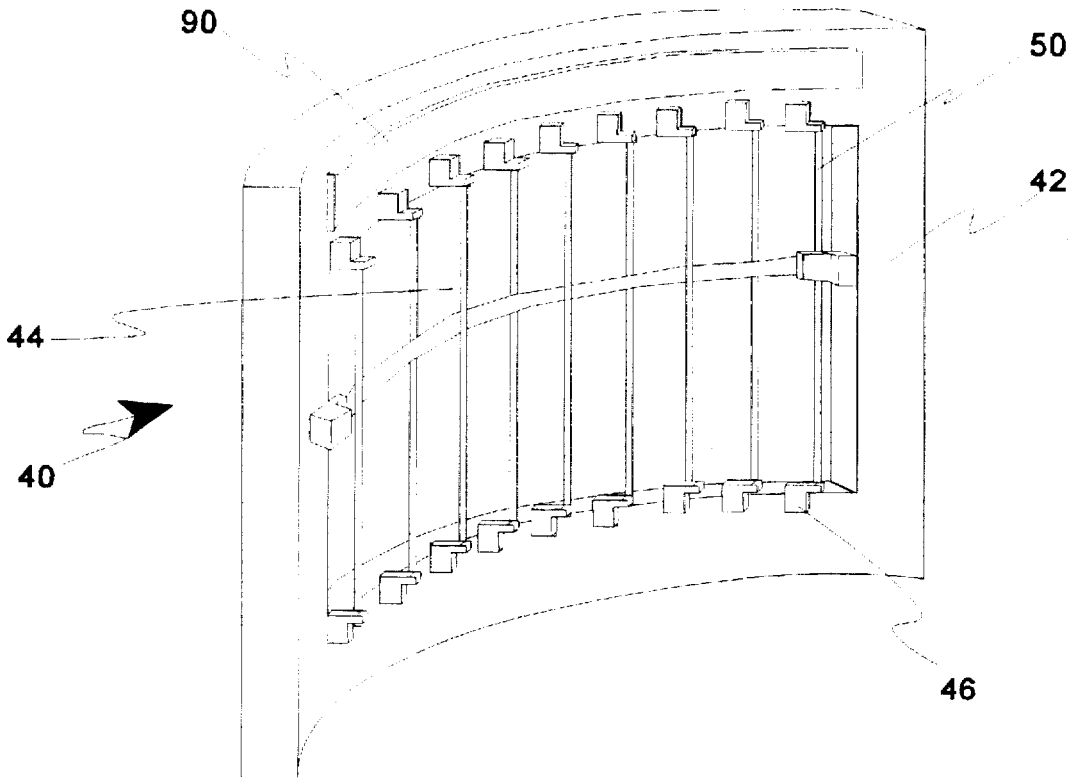
FIG. 11 is a top plan view of another embodiment of an apparatus according to the present invention.

FIG. 11 illustrates apparatus 40 having frame member 42 in an arcuate shape. Frame member 42 has barrette 90 attached to the upper edge thereof and this embodiment is especially useful for hair ornamentation. If any elastic bands 50 are placed horizontally on this embodiment, it will be necessary to interweave them with the vertical elastic bands so that the horizontal elastic bands will follow the shape of frame member 42, as is shown on FIG. 11.

Figure 12:
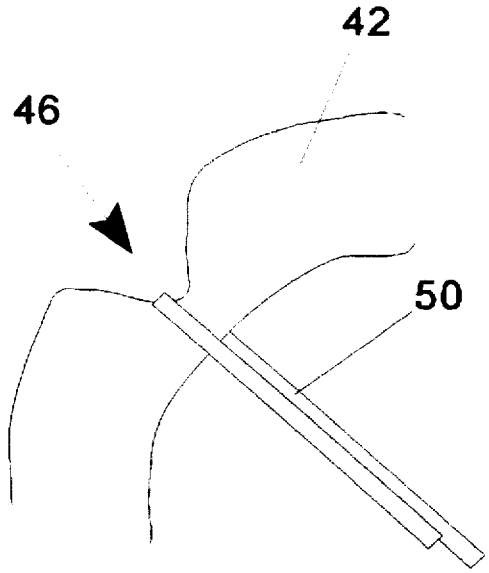
FIGS. 12–15 are fragmentary, top plan views showing alternative hook members for attaching elastic bands to any of the apparati of the present invention.
Figure 13:
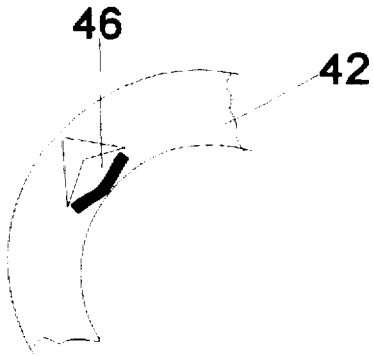
Figure 14:
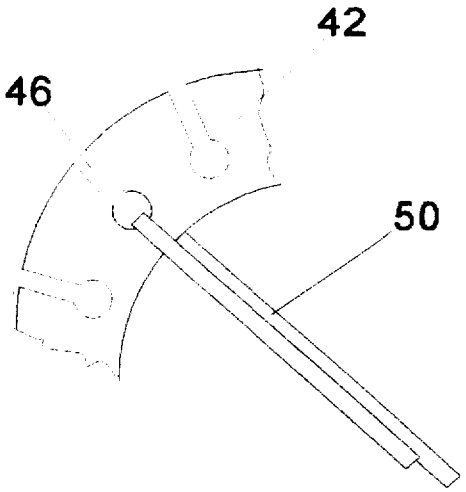
Figure 15:
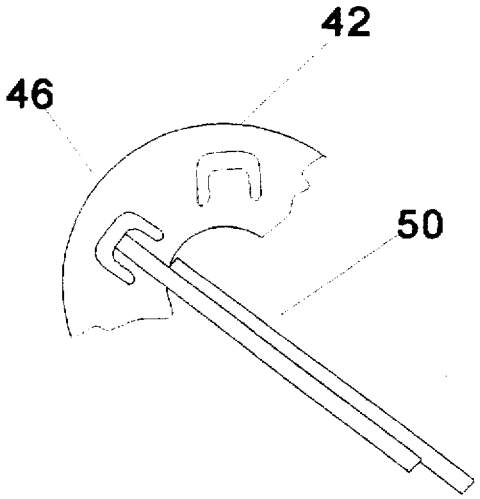
Figure 16:
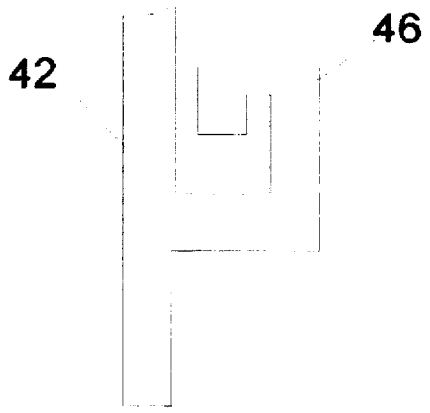
FIGS. 16 and 17 are side elevational views, in cross-section, showing alternative hook members for attaching elastic bands to any of the apparati of the present invention.
Figure 17:
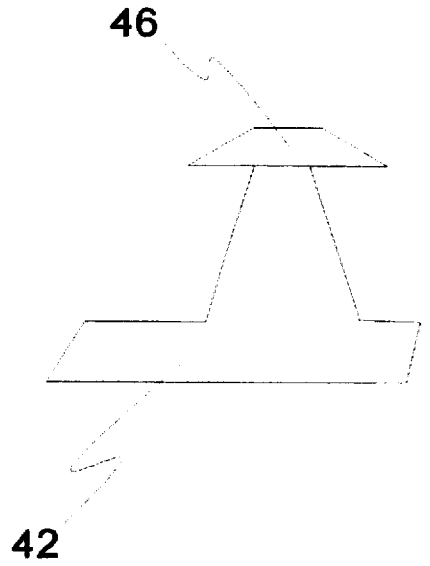

FIGS. 12–15 illustrate different arrangements for hook member 46. FIGS. 12 and 14 illustrate hook member 46 as a cutout in the outer peripheral edge of frame member 42. On FIG. 13, hook member 46 has been formed by cutting a tab in frame member 42 and bending the tab upwardly. On FIG. 15, hook member 46 is attached to frame member 42. On FIGS. 16 and 17, hook member 46 is molded integrally with frame member 42. Other configurations of hook member 46 are also possible and within the contemplation of the present invention.

Frame member 42 can be manufactured of plastic, wood, or metal and is preferably manufactured by conventional thermoplastic injection molding techniques, with hook members 46 molded integrally with the frame member.

Decorative bows created with the present invention can be used in many different applications. In addition to the hair ornamentation and blouse pin uses suggested above, a bow created by the present invention can be attached to a waist cincher, to a shoe clip, or to a package, to name only a few possibilities.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A method for creating a finished decorative article with a bow from a fabric, comprising:

(a) providing a frame member having a central opening and at least two hook members disposed on said frame member around said central opening;

(b) positioning at least one band between a selected pair of said at least two hook members across said central opening;

(c) providing said fabric in the form of an elongated piece of material folded with at least one resulting fold; and (d) forming loops of said fabric between sides of said at least one band, between at least one band and another band, and optionally between at least one of said bands and said frame member, wherein two or more of said loops of fabric form said bow;

and said frame member and said loops of fabric together forming a finished decorative article that may be used as an accessory to dress apparel or as package ornamentation.

2. A method for creating a bow, as defined in claim 1, further comprising: providing said frame member with a shape selected from the group consisting of a rectangle, a two-dimensional spiral, a three-dimensional spiral, a triangle, an annulus, an oval, a trapezoid, a polygon, a square, a parallelogram, and an arcuate rectangle.

3. A method for creating a bow, as defined in claim 1, further comprising: providing said frame member with a rectangular shape and having a plurality of vertically and horizontally aligned pairs of said at least two hook members.

4. A method for creating a bow, as defined in claim 1, further comprising:

(a) providing said frame member with an arcuate rectangular shape and having a plurality of vertically and horizontally aligned pairs of said at least two hook members; and (b) interweaving vertical and horizontal bands between pairs of said at least two hook members.

5. A method for creating a bow, as defined in claim 1, further comprising: providing attachment means attached to said frame member for attachment of said frame member to another object.

6. A method for creating a bow, as defined in claim 5, further comprising: providing attachment means selected from the group consisting of a pin and a barrette.

* * * * *